United States Patent [19]

Anderson

[11] 3,946,995

[45] Mar. 30, 1976

[54] INTER ARC INGREDIENT MIXER

[76] Inventor: Warren W. Anderson, 7208 Newton Ave. South, Minneapolis, Minn. 55423

[22] Filed: July 26, 1973

[21] Appl. No.: 382,880

[52] U.S. Cl. ..... 259/9; 259/DIG. 25

[51] Int. Cl.[2] ..... B01F 7/10

[58] Field of Search ..... 259/9, 10, 109, 110, 5, 259/6, 7, 8, 25, 26, 45, 46, 104, DIG. 25, DIG. 26

[56] References Cited

UNITED STATES PATENTS

| | | | |
|---|---|---|---|
| 3,012,763 | 12/1961 | Martin | 259/9 |
| 3,168,292 | 2/1965 | Joschko | 222/129.1 |
| 3,253,818 | 5/1966 | Seddon | 259/9 |
| 3,259,374 | 7/1966 | Doebl | 259/10 |
| 3,290,015 | 12/1966 | Guetschow | 259/9 |
| 3,330,536 | 7/1967 | Efstathiou | 259/10 |
| 3,346,239 | 10/1967 | Larson | 259/9 |
| 3,403,523 | 10/1968 | Bauer | 259/9 |
| 3,419,250 | 12/1968 | Brennan | 259/6 |
| 3,446,485 | 5/1969 | Fischer | 259/6 |
| 3,684,458 | 8/1972 | McCammon | 259/10 |

*Primary Examiner*—Robert W. Jenkins
*Attorney, Agent, or Firm*—Warren A. Sturm

[57] ABSTRACT

An ingredient whipper that utilizes the mixing action of a plurality of rotating axially spaced apart inclined blades of segmental arc, cycloidal like, configuration in a chamber that is adapted to receive materials to be mixed through one opening and to discharge the same through another opening. The segmental arc blades may coact with a further longitudinally extending rib of segmental arc cross section in the chamber to provide a complete mixing of the ingredient materials supplied to the chamber. The blades are disposed in such a manner as to direct the materials being mixed in a direction away from the outlet opening in the chamber.

10 Claims, 6 Drawing Figures

2
25
10
12
11
26
17
4
22
S
14
16
18
21
13
20
19
15
23
3

INTER ARC INGREDIENT MIXER

SUMMARY OF THE INVENTION

This invention concerns the efficient mixing of two or more ingredients as they pass through a mixing chamber. In, for example, the vending industry, it is desired to mix liquid and solid material under circumstances wherein the liquid may be water which can be supplied locally to a vending machine and the other ingredient may be liquids or solids which can be stored in various compartments of a machine and common access to an inlet to a mixer may be achieved so that the materials may be introduced into a mixing chamber simultaneously for complete mixing to form a homogeneous mass of material prior to discharge into a receptacle, such as a cup or the like.

In my invention I have discovered that more complete and efficient mixing of the ingredients may be achieved through the use of a whipping element which is comprised of a number of axially spaced semi-arcuate or cycloidal portions of disks which are mounted at an inclined angle with respect to a longitudinal axis of a rotatable whipper that is disposed in a cylindrical chamber. The axis of rotation of the whipper is coaxial with that of the cylindrical chamber.

Rotation of the whipper provides an action tending to direct the materials, introduced into an inlet for the cylindrical chamber, toward an outer end that is away from an outlet opening disposed in another portion of the cylindrical chamber. An inwardly extending rib having a substantially arcuate cross section is disposed adjacent the inlet and circumferentially forwardly of the inlet with respect to the rotation of the whipper element.

These and other objects of my invention may become apparent from a consideration of the appended specification, claims and drawing in which:

Figures 1, 2, 3, 4, 5, 6:
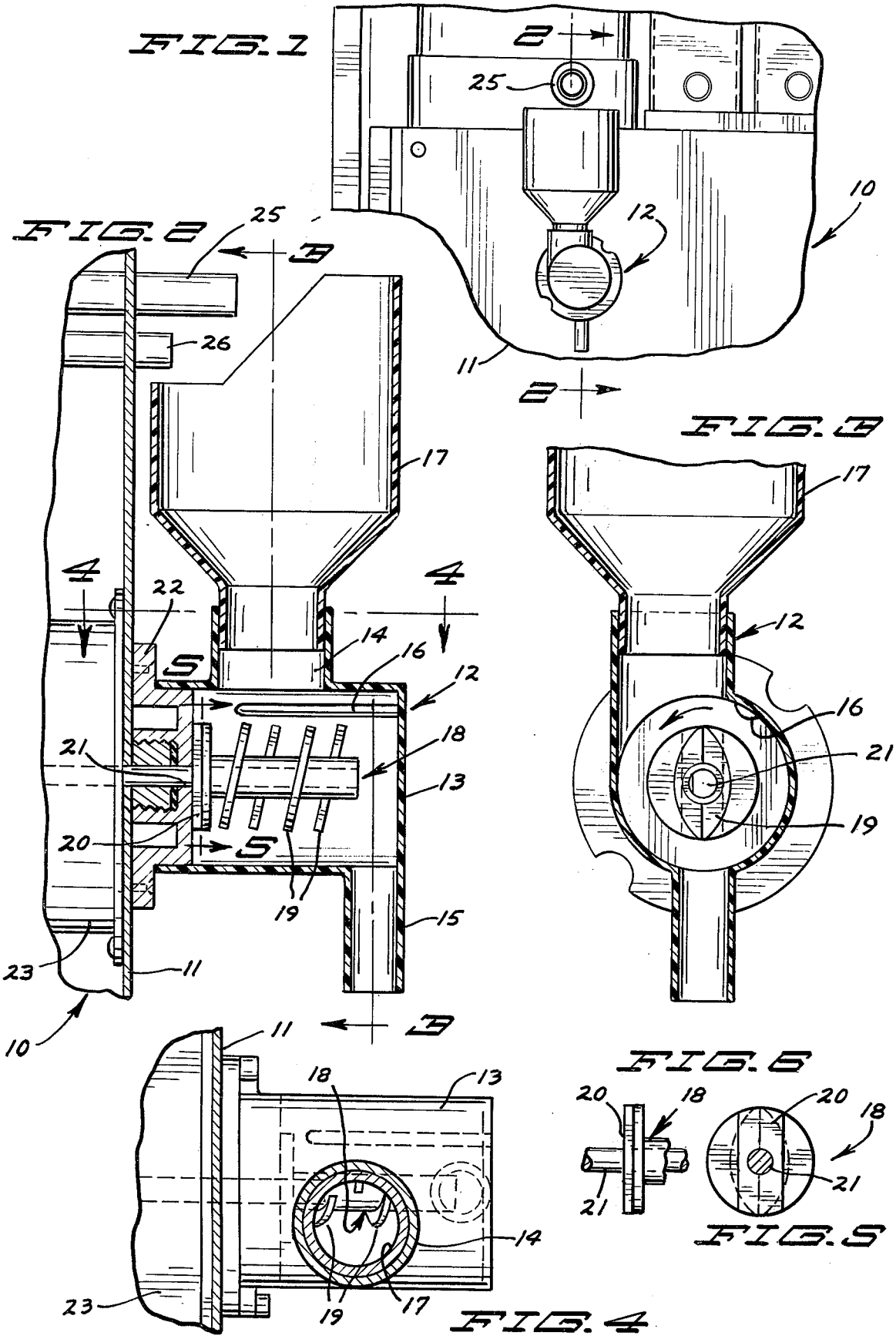
FIG. 1 is a fragmentary front elevational view of a portion of a vending apparatus to which the principles of my invention have been applied.
FIG. 2 is an enlarged fragmentary sectional view taken along section lines 2—2 on FIG. 1 of the drawing.
FIG. 3 is a fragmentary sectional view taken along section line 3—3 on FIG. 2 of the drawings.
FIG. 4 is a fragmentary sectional view taken along section line 4—4 on FIG. 2 of the drawings.
FIG. 5 is a partial sectional view taken along section line 5—5 on FIG. 2 of the drawings.
FIG. 6 is a fragmentary top elevational view of a portion of the elements of my invention.

Referring now to the drawings in which like elements have been identified by like reference characters, there is shown a vending machine indicated generally by reference character 10 which is provided with an interior front wall 11. A mixer is indicated generally by reference character 12 and includes a cylindrical chamber element 13 that is disposed in a generally horizontal attitude with respect to its longitudinal axis.

Chamber 13 includes an inlet 14 substantially at its top portion and spaced slightly inwardly from the left outer end thereof as well as a downwardly opening outlet 15 spaced adjacent the right end wall. An inwardly extending rib 16 of substantially arcuate shape is disposed longitudinally of chamber 13 adjacent the side of material inlet 14 and a funnel 17 is disposed on top of and extending inwardly into inlet 14 to receive and direct the flow of ingredients therethrough.

A whipper element is indicated generally by reference character 18 and includes a longitudinally extending central portion which is dapted to receive and be mounted upon a motor shaft for rotation within chamber 13. Whipper 18 includes a plurality of axially spaced blades 19 of generally cycloidal and/or semi-arcuate shape, each being inclined at an angle to the longitudinal axis of whipper 18 and adapted to, when rotated therein, direct ingredients passing into inlet 14 toward the left outer end of cylindrical chamber 13. Whipper 20 also includes, at its left hand end as viewed in FIG. 2 of the drawings, a slinger element 20 which is useful to direct material outwardly to the cylindrical outer walls of chamber 13 when whipper 18 is rotated so as to tend to prevent the flow of ingredient material onto shaft 21.

The left outer wall of chamber 13 is shown comprised of a cover member 22 which is suitably mounted upon front wall 11 of vending apparatus 10 in proximity to and concentric with shaft 21 of a motor 23 which is likewise suitably mounted upon front wall 11 of vending apparatus 10. Motor 23 may be energized from a suitable source of energy (not shown) when it is desired to utilize the mixer to agglomerate ingredients that are placed therein.

As one example of sources of ingredients, there are shown tubes 25 and 26 extending outwardly of front wall 11 on vending apparatus 10 over the open top of funnel member 17. These ingredients could be, for example, coffee concentrate and water, or any one of a number of other ingredients which may be mixed and then dispensed to the consumer. The conveying of other ingredients to funnel 17 is not within the scope of the present application and therefore only two sources are shown by way of example only.

Having now therefore fully illustrated and described my invention, what I claim to be new and desire to protect by Letters Patent is:

1. In ingredient mixers of the class above described, the combinaton, comprising;

a. a cylindrical chamber having a generally horizontal axis, an inlet positioned at the approximate top midway between the end walls thereof, an outlet adjacent one of the end walls, and a shaft disposed coaxially of said cylindrical chamber extending into the other end wall of said chamber;

b. a whipper disposed on said shaft for rotation therewith, said whipper including a plurality of axially spaced apart blades of segmented configuration, said blades being inclined with respect to the longitudinal axis of said shaft and parallel with one another and adapted to be rotated in a direction which causes ingredients from said inlet to be impelled circumferentially in the direction of rotation of said shaft and to direct portions of the ingredients toward said other end of said cylindrical chamber.

2. The apparatus of claim 1 in which the chamber includes at least one inwardly, longitudinally extending rib member adjacent the inlet thereof.

3. The apparatus of claim 2 in which a generally circular member is disposed on the shaft adjacent the other end of said cylindrical chamber for rotation therewith.

4. The apparatus of claim 2 in which the rib member is disposed near the top of said cylindrical chamber whereby ingredients which have attained a circumferential motion upon rotation of the shaft, are directed toward the top of said shaft.

5. The apparatus of claim 1 in which the blades are comprised of arcuate portions of a circle.

6. The apparatus of claim 5 in which a generally circular member is disposed on the shaft adjacent the other end of said cylindrical chamber for rotation therewith.

7. The apparatus of claim 1 in which the blades have an outer configuration of cycloidal characteristics.

8. The apparatus of claim 7 in which a generally circular member is disposed on the shaft adjacent the other end of said cylindrical chamber for rotation therewith.

9. The apparatus of claim 1 in which the blades have a circular-like outer configuration.

10. The apparatus of claim 1 in which a generally circular member is disposed on the shaft adjacent the other end of said cylindrical chamber for rotation therewith.

* * * * *